US006938590B2

(12) United States Patent
Buelna

(10) Patent No.: US 6,938,590 B2
(45) Date of Patent: Sep. 6, 2005

(54) ROTARY PISTON MOTOR

(76) Inventor: Terry Buelna, 15872 Standish La., Huntington Beach, CA (US) 92647

( * ) Notice: Subject to any disclaimer, the term of this patent is extended or adjusted under 35 U.S.C. 154(b) by 0 days.

(21) Appl. No.: 10/823,266

(22) Filed: Apr. 13, 2004

(65) Prior Publication Data

US 2004/0206316 A1 Oct. 21, 2004

Related U.S. Application Data

(60) Provisional application No. 60/463,048, filed on Apr. 16, 2003.

(51) Int. Cl.[7] ..... F02B 75/18; F02B 57/00; F01B 13/04; F01B 3/00

(52) U.S. Cl. ..... 123/56.8; 123/43 A; 123/43 AA; 92/57; 92/71

(58) Field of Search ..... 123/241, 43 A, 123/43 AA, 45 R, 45 A, 56.8; 92/57, 71; 384/58, 416, 418, 396

(56) References Cited

U.S. PATENT DOCUMENTS 1,622,986 A 3/1927 Weingartner ..... 123/43 AA
1,798,866 A * 3/1931 Bleser ..... 123/56.8
1,828,353 A * 10/1931 Bleser ..... 123/56.8
2,237,989 A * 4/1941 Herrmann ..... 123/56.8
3,598,094 A * 8/1971 Odawara ..... 123/56.8
4,492,188 A * 1/1985 Palmer et al. ..... 123/56.8
4,571,946 A * 2/1986 Demopoulos ..... 123/56.8
5,209,190 A * 5/1993 Paul ..... 123/43 AA
6,601,548 B2 * 8/2003 Al-Hawaj ..... 123/43 AA
6,662,775 B2 * 12/2003 Hauser ..... 123/241
6,698,394 B2 * 3/2004 Thomas ..... 123/43 A
6,834,636 B2 * 12/2004 Thomas et al. ..... 123/43 A

* cited by examiner

*Primary Examiner*—Thai-Ba Trieu
(74) *Attorney, Agent, or Firm*—Stetina Brunda Garred & Brucker

(57) ABSTRACT

An internal combustion, reciprocating piston, motor has a rotating cylinder block. A journal bearing supports a roller that is fastened to a piston connecting rod or fastened to the piston so the roller pushes against an inclined surface on a stationary guide track fastened to a motor housing in order to cause the cylinder block and pistons to rotate. A lubricant is fed from a passageway on the rotational axis of the drive shaft radially outward, through passageways that align, and though a skirt on the piston, in order to lubricate the journal bearing. The rotating piston chambers are sealed against a stationary cylinder head by annular rings at the end of each chamber, and by curved linear seals extending between adjacent annular rings.

20 Claims, 9 Drawing Sheets

ROTARY PISTON MOTOR

CROSS-REFERENCE TO RELATED APPLICATIONS

This application claims priority under 35 U.S.C. §119 (e) to provisional patent application No. 60/463,048, filed Apr. 16, 2003, Terry Buelna inventor.

BACKGROUND OF THE INVENTION

This invention involves a rotary piston motor having pistons that reciprocate parallel to a central drive shaft while the pistons also rotate around that drive shaft with the engine casing remaining stationary.

Such rotary motors have been previously designed for envisioned use as motors to rotate a shaft, or conversely to pump fluid from the piston cylinders if power is supplied to rotate the shaft. But prior rotary motors have not been commercially viable products, in part because of unacceptable wear, reliability and performance, and in part because of the engine complexity. There is thus a need for a rotary piston motor that is simpler yet more reliable.

BRIEF SUMMARY OF THE INVENTION

By way of overview, the rotary motor disclosed herein increases motor efficiency, life and reliability by using a journal bearing on the piston to more efficiently and durably carry the transmitted forces that a roller exerts on a guide track. The motor also preferably, but optionally provides a lubricating and cooling fluid to that journal bearing, and does so through a passageway design that uses centrifugal help force to facilitate flow through the fluid passageways. Further, a centrifugally fed, lubricating fluid passageway is provided to an inner surface of the guide track to reduce wear and increase cooling of the abutting surfaces which carry the centrifugal forces of the rotating motor. Lateral seals are also provided between the annular seals at the end of each piston cylinder, to improve the sealing of the rotary portion of the motor. Advantageously two rings of lateral seals are provided, and inner and outer ring concentric about the rotational axis, and spaced apart by the annular cylinder bore seals.

In more detail, an internal combustion, reciprocating piston, rotary motor is provided. The connecting rod of the piston or a skirt on the piston supports a rolling surface which pushes against an inclined surface on a stationary guide track fastened to the motor housing in order to cause the cylinder block and pistons to rotate. As the cylinder block rotates the chambers in which each piston is located over stationary portions of the cylinder head configured to allow the ignition, compression, power and exhaust strokes of the engine cycle to occur. But because the pistons and cylinders are rotating there need only be one spark or glow plug ignition, only one inlet port and only one outlet port, and those parts can be stationary. Preferably the pistons are double headed pistons connected by a connecting rod so that each piston has rollers with each of the pair of rollers abutting opposing sides of the guide track.

Preferably, but optionally, the roller which contacts the guide track and which transfers linear piston motion into rotary motion is supported by a journal bearing. This allows a more efficient transfer of high loads while reducing wear compared to prior art rollers. Pinning or bolting or otherwise supporting the roller and journal bearing between opposing skirts of the piston allows for simple and efficient mounting of the bearing and roller.

But the piston skirts inhibit lubrication of the roller and the journal bearing requires more lubricant, thus the motor preferably, but optionally, has lubricating passages formed to supply sufficient lubricant to the journal bearing and/or roller to allow suitable use of the motor. Advantageously, but optionally, an oil passageway along the drive shaft of the motor is in fluid communication with outwardly extending passageways through the drive shaft, piston, and connecting rod in order to lubricate the journal bearing. Further, centrifugal rotation of the drive shaft is advantageously used to assist the lubricant flow. Preferably, but optionally, a passageway on the axis of rotation aligns has outwardly extending passages with openings that periodically align with radial passageways through the piston and/or connecting rod in order to lubricate the roller. Because of the rotation of the drive shaft and the rotation of the pistons around the drive shaft, this can result in the pumping of lubricant to the pistons.

Further, there is also preferably, but optionally, a fluid path in the journal bearing having a first end that opens onto a radial face of the bearing and an another end that opens onto the roller so the inner face of the roller acts as part of the journal bearing, with the first end being aligned with the fluid lubricating passageways through the piston. Because of the rotation of the drive shaft and the rotation of the pistons around the drive shaft, this can result in the pumping of lubricant through the pistons and to the journal bearing, and the further radial alignment of fluid passageways in the piston with the fluid passageway in the journal bearing and with the fluid passageways in the drive shaft. This provides a simple and efficient lubricating and cooling fluid to the roller.

The cylinders within which the pistons reciprocate have ends that abut the stationary cylinder heads so the cylinders rotate relative to those stationary cylinder heads. Annular seals are interposed between the cylinder head and the rotating cylinder block, around the end of each piston's cylinder. Curved and segmented linear seals are placed between adjacent annular seals to further seal the stationary cylinder head relative to the rotating cylinder block. Preferably, but optionally, there are inner and outer curved, linear seals, radially spaced relative to the axis of rotation of the rotating cylinder block.

BRIEF DESCRIPTION OF THE DRAWINGS

These and other features and advantages of the rotary piston motor will become more apparent in view of the following drawings and description in which like numbers refer to like parts throughout, and in which:

FIG. 2*a* is a section taken along 2*a*—2*a* of FIG. 1*c,* while

DETAILED DESCRIPTION

Figure 1C:
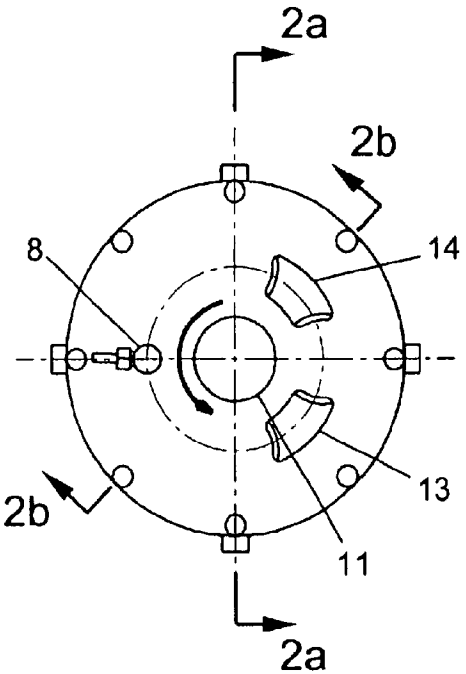
FIGS. 1*a*–1*c* are side, front and rear views of a preferred embodiment of a rotary piston engine.
Figure 1A:
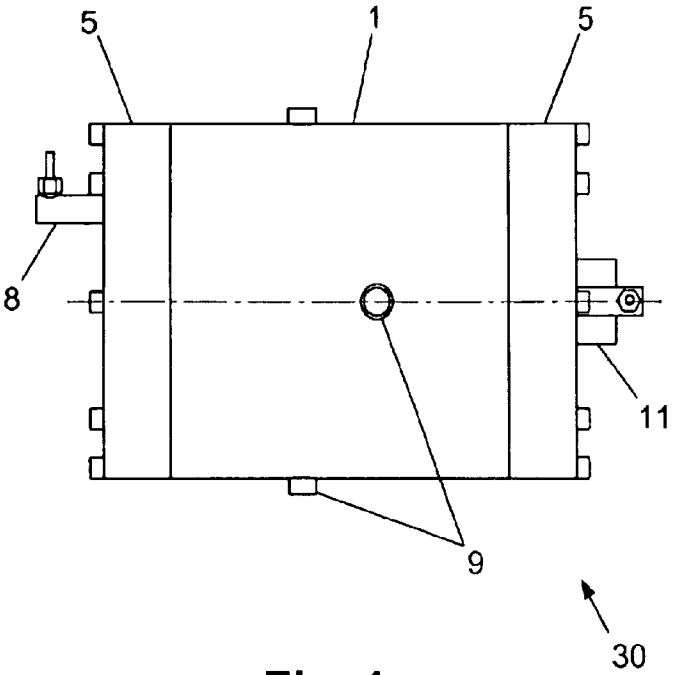
Figure 1B:
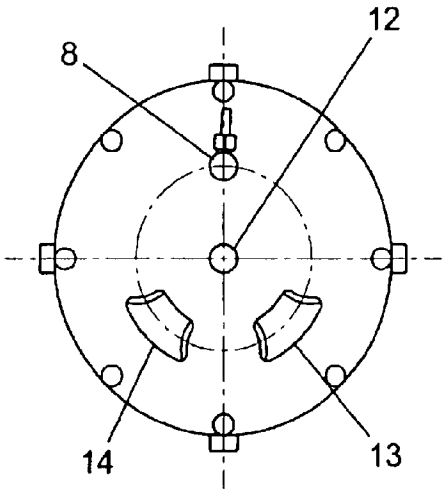
Figure 2A:
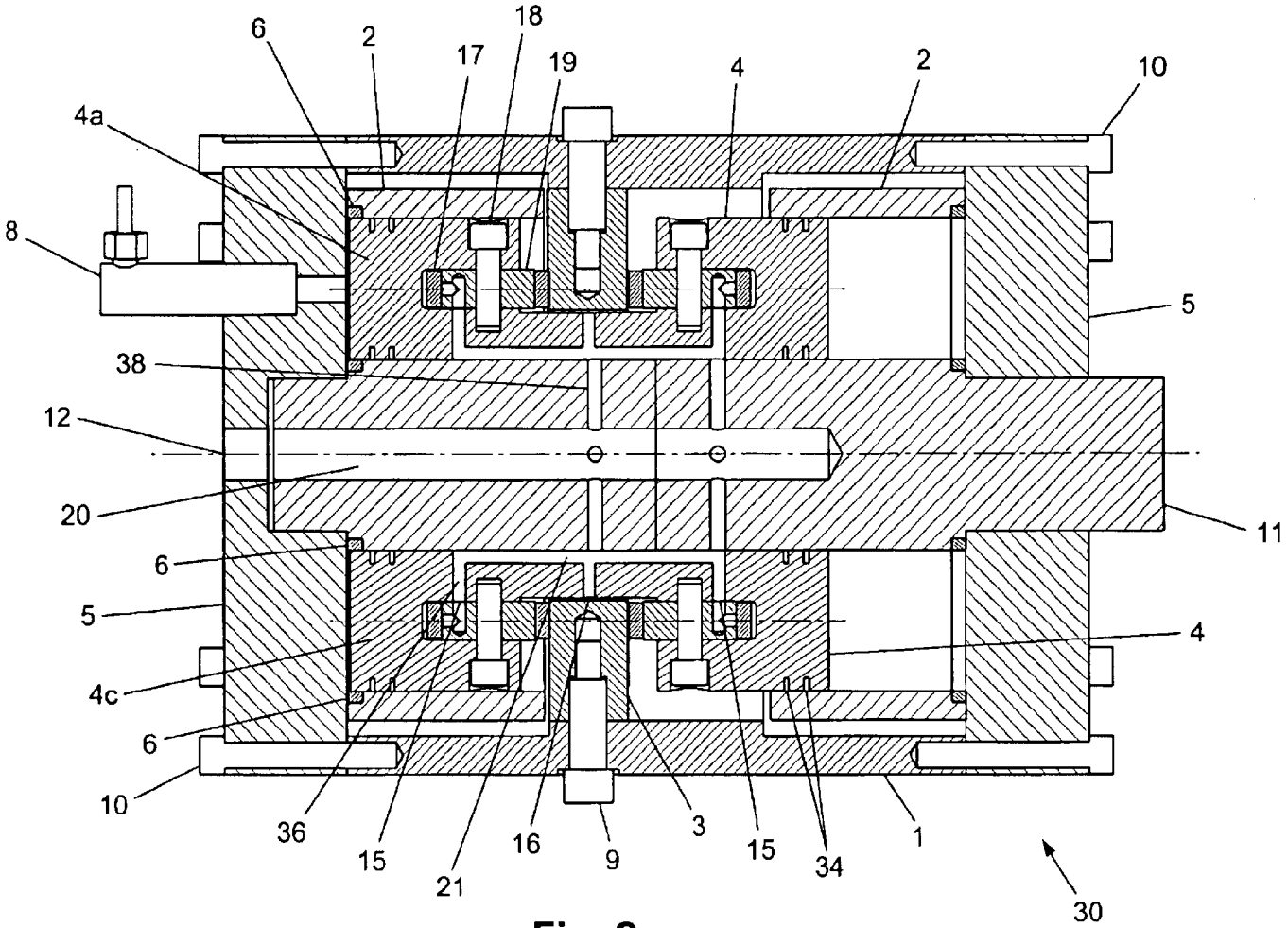
Figure 2B:
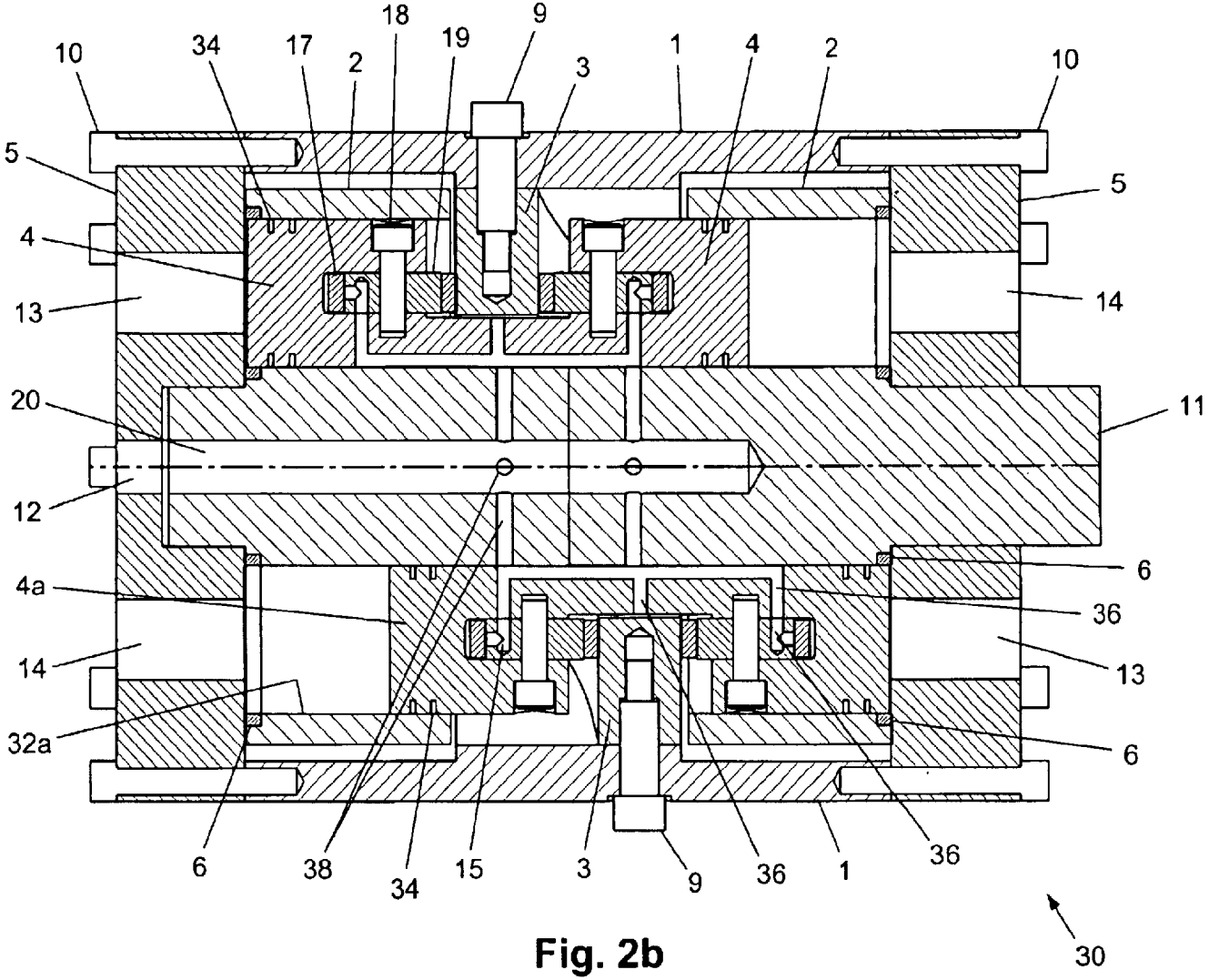
FIG. 2*b* is a section view taken along 2*b*—2*b* of FIG. 1*c;*
Figure 3:
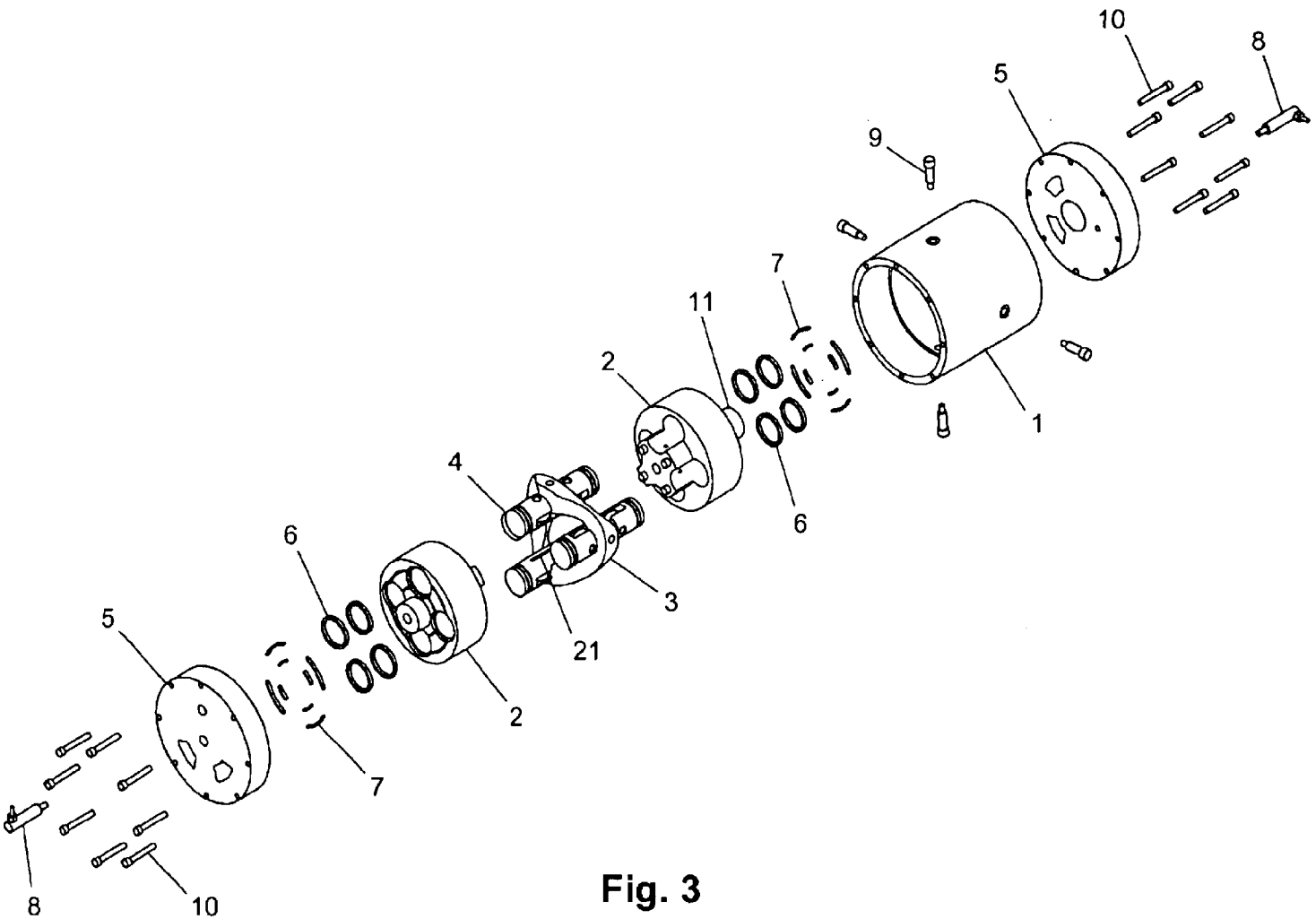
FIG. 3 is an exploded view of the motor of FIG. 1.

Referring to FIGS. 1–3, an internal combustion, reciprocating piston, rotary motor 30 is provided. This motor 30 can be adapted to either two-cycle or four-cycle operation. It is also adaptable for either spark-ignited or compression-ignited use. The motor 30 has one or more reciprocating pistons 4, and preferably has an even number of pistons. The engine 30 may be used in any application that a conventional reciprocating piston internal combustion engine is used. The motor 30 shown and described herein is a double-ended configuration with four pistons and four cylinders, with intake/exhaust porting for four-cycle operation. The engine configuration would be equivalent to an eight cylinder conventional reciprocating engine. But the engine 30 can be produced with any number of cylinders desired, and the cylinders can be double ended or single ended.

The engine 30 has a stationary (non-rotating) engine casing or crankcase 1 that preferably takes the form of a cylindrical, tubular shape, although other shapes could be used. The crankcase 1 is typically made of metal, such as aluminum or steel. Contained within the non-rotating crankcase 1 is a rotating cylinder block 2 within which pistons 4 reciprocate. Fastened to the non-rotating crankcase 1 is a guide track 3 which controls the reciprocating motion of the pistons 4 and provides a bearing surface to control the radial position of the pistons as described later.

The rotating cylinder block 2 is split into 2 pieces to facilitate installation of the piston assemblies. The cylinder block 2 rotates about the longitudinal axis of drive shaft 11 which has an output end extending through an opening in one of two opposing cylinder heads 5. The other end of the drive shaft is rotatably mounted in the opposing cylinder head 5. The shaft is advantageously pined or bolted to the rotating cylinder block, but can be connected in various ways known in the art. The cylinder heads 5 connect to the ends of the tubular crankcase 1 to enclose the mechanism forming the basic parts of the engine 30. A plurality of fasteners 10, such as bolts, is believed suitable to fasten the cylinder heads 5 to the cylinder block 2. The shape of the rotating cylinder block 2 is affected by several other parts and will be described later.

Contained within the rotating cylinder block 2 are one or more reciprocating pistons 4, that reciprocate within cylinders 32 formed in the rotating cylinder block 2. Annular seals such as piston rings 34 set in grooves 34' are used to provide a seal between each of the four cylindrical pistons 4 and the respective cylinder 32 associated with each piston. Each cylinder bore seal 34 rests in a groove 34' (FIGS. 10*a*–10*f*) in the associated piston 4 and the seals are located toward the head of the piston 4. The seals 34 slide against the inside face of cylinder 32. Thus, the piston cylinder 32 will have a variable volume defined by the cylindrical walls of the chamber 32, the head of the piston 4, and the portion of the cylinder head 5 aligned with the rotating chambers 32 at any particular point in the combustion cycle as the piston and cylinder rotate about the drive shaft 11.

The ends of the cylinders 32 abut the cylinder heads 5, and annular seals 6 are placed between each of the cylinders 32 and the cylinder heads 5 to contain the combustion gas pressure within the cylinder bore 32. The seals 6 are advantageously in recesses 6' (FIG. 12*c*) formed in the rotating cylinder block 2. The piston 4 may have gas pressure working on only one end (single-ended) or on both ends (double-ended). The piston body example shown in FIGS. 1–12 is double-ended. The seals 6 prevent combustion gases from going between the rotating cylinder block 2 and the stationary cylinder head 5 and reaching the inside of the crankcase 1.

Each cylinder head 5 contains an inlet port 14 and an exhaust port 13. These preferably comprise open ports or holes passing through the cylinder head 5 and opening into the chambers or cylinders 32 associated with each piston 4 as each piston rotates across each port 13, 14 with the rotation of the rotating cylinder block 2. Intake and exhaust seals 7 (FIGS. 3, 12*a,* 12*c*) are also provided to prevent intake/exhaust gas pressure from leaking into the crankcase 1 between the rotating cylinder block 2 and stationary cylinder head 5.

A fuel device 8 is provided. Advantageously, but optionally, the fuel device 8 extends through one of the cylinder heads 5 at a location selected to coincide with or near to the top dead center (TDC) of the pistons 4 as they rotate. Advantageously a fuel injector 8 is provided and the combustion cycle uses compression to ignite the combustion gases. As needed a glow plug can be provided adjacent the fuel injector 8 or at another suitable location. If the motor 30 uses a combustion cycle requiring spark ignition, then a spark plug can replace the fuel injector 8. A carburetor (not shown) would then be located outside the motor 30 to achieve the desired mix of fuel and air entering the inlet 14, or alternatively a fuel injector could be provided at a suitable location.

The drive shaft 11 advantageously has opposing ends each held in a different one of the cylinder heads 5, whether the pistons 4 are single or double ended. The end of the drive shaft 11 which is opposite the output end of the shaft, advantageously has a central passageway 20 located or parallel to and preferably at the rotational axis of shaft 11 so that a lubricant such as oil can be introduced along the rotational axis. The shaft passageway 20 is typically a cylindrical hole. The passageway 20 is in fluid communication with an inlet fluid passageway 12 located in the appropriate cylinder head 5. One or more outwardly extending passageways 38 are formed in the shaft 11. The outward passageways 38 are in fluid communication with the central oil passageway 20 and open onto an outward surface of the rotating shaft 11. Feeding lubricating/cooling oil or fluid through the inlet 12 into the central passageway 20 is useful because the rotation of the cylinder block 2 and attached shaft 11 helps to pump the oil. As the oil passes across the moving parts it lubricates and cools the parts of the motor 30.

Figure 5:
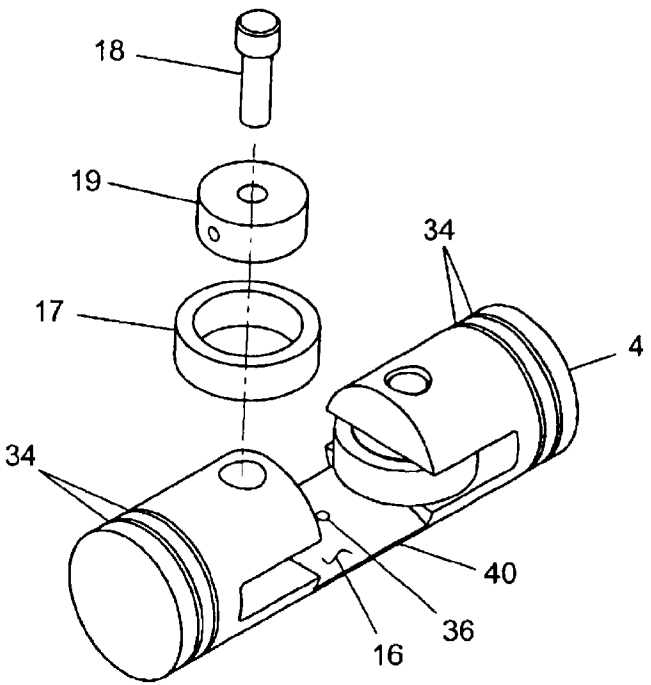
FIG. 5 is a partially exploded perspective view of a double headed piston shown in FIG. 1*a;*

Referring to FIGS. 2, 3 and 5, the pistons 4 are shown as double headed pistons because the motor 30 is a double ended engine. Each piston 4 has a cylindrical head with piston rings 34 in grooves in the piston head to seal the piston against the walls of the cylinder bore 32 in which the piston reciprocates.

The two opposing piston heads 4 are joined, preferably along one side of the piston 4 by a connecting rod 40 that is parallel to the reciprocating axis of the motor 30. The connecting rod 40 advantageously has an exterior or outer surface curved to conform to the shape of the cylindrical piston head and the cylindrical bore 32. A bearing surface 16 is located on an interior side of the connecting rod 40. The rod is advantageously formed integrally with piston 4 as by casting or die-casting or molding. Advantageously, but optionally, a fluid passageway 42 extends from the interior to the exterior surfaces of the connecting rod. A cylindrical passageway is believed suitable for the passageway 42.

Located on the longitudinal, reciprocating axis of the piston 4 is a piston roller 17, which rotates about bearing 19 fasteners. Fastener 18 extends between opposing skirts of the piston head 4 and clamps bearing 19 in place. The fastener 18 preferably extends along an axis radially outward from the rotational axis of the drive shaft 11. The piston 4 reciprocates along an axis parallel to the longitudinal axis of shaft 11, and the roller 17 rotates about an axis orthogonal to the reciprocating axis of the piston 4 and longitudinal axis of shaft 11. The roller 17 is preferably, but optionally journaled on journal bearing 19. Thus the journal bearing 19 comprises a disk with a central hole through which fastener 18 extends. The piston roller 17 advantageously comprises an annular ring that fits over the outside of the journal bearing 19. The inner face or inner diameter of the roller 17 forms half of the roller journal bearing 19, with a slight space of a few thousandths of an inch, or less, between the two abutting parts to allow oil to lubricate the relative motion of the parts.

The bearing 19 could optionally be mounted to rotate about a shaft 18 fastened to the piston 4, and preferably fastened to opposing skirts of the piston. But if the bearing 19 rotates then lubricating it can be difficult. Thus, it is preferable that the bearing 19 be fixed to the shaft 18 and that a lubricating passageway extends to, and preferably through the bearing 19. Advantageously the bearing 19 forms a disk having opposing sides that fit closely with opposing sides of the skirt of the piston 4. A threaded fastener 18 can pass through the center of the disk 19 and clamp the disk between the two piston skirts to lock the piston in position so that the fluid passageway 15 in the disk is aligned with the fluid passageway 36 in the piston. The outer surface of the disk 19 is close to the inner surface of roller 17. The outer surface of the disk 19 provides the inner race of a journal bearing, and the inner surface of the roller 17 provides the outer race of the journal bearing. There is thus advantageously provided a fluid passageway 38, 21, 36, 15 extending radial outward from the oil passageway 20 in the drive shaft, to lubricate the journal bearing about which roller 17 rotates.

The bearing 19 and roller 17 are located close to or on the longitudinal, reciprocating axis of pistons 4, and are ideally located in line with the piston assembly's center of gravity and the piston crown's center of pressure.

The shape of the rotating cylinder block 2 can now be understood, and is best seen in FIGS. 2–3. The cylinder block preferably has a cylindrical periphery to facilitate rotation within the housing 1 of motor 30. The drive shaft 11 extends from the center of the rotating cylinder block 2. Each distal end of the rotating cylinder block 2 abuts one of the cylinder heads 5, and contains completely within the block 2 the plural cylinder chambers 32 and pistons 4 sufficient for the intake, compression, combustion and exhaust cycles to occur without the gases leaking into the interior of the motor 30.

The interior portion of the rotating cylinder block 2 need not completely enclose the skirts of the pistons 4 and in the illustrated embodiment does not do so. As best seen in FIG. 3, exterior portions of the drive shaft 11 have recesses that form portions of a cylinder to receive the skirt of an associated piston 4 and to allow the alignment of passageways suitable for providing oil to several surfaces as described herein. The recesses in the drive shaft 11 enclose about one-quarter of the piston 4 while the cylindrical portion of the cylinder block 2 always encloses the head of the circumference of piston 4 and piston rings 34.

As best seen in FIGS. 2, 3, 12*a* and 12*c*, the end of the piston cylinders 32 are sealed to the cylinder heads 5 by annular rings 6 placed in grooves 6' and there are four cylinders 32 and four ring seals 6 in each of the two rotating cylinder heads 2. But the cylinders 32 and seals 6 are spaced apart on a circle centered on the rotational axis of shaft 11. In order to better seal the rotating cylinder block 2 against the stationary cylinder head 5, curved seals 7 are interposed in curved slots 7' located between the distal end of the rotating cylinder block 2 and the cylinder head 5, with the seals 7 and recesses 7' extending along an arc between adjacent cylinder bores 32 and the associated seals 6. The seals 7 and recesses 7' are curved along circles concentric to the rotational axis of the shaft 11 and rotating cylinder head 2. As there are four cylinders 4 in the depicted embodiment, there are four, shorter inner seals 7 and inner slots 7', and four longer, outer seals 7 and slots 7' located radially outward of the inner seals 7. The seals 7 and slots 7' help prevent gases from entering or exiting radially toward or away from shaft 11. Advantageously, the recess or slots 6' intersect or open into the recesses 7' for sealing segments 7.

The seals 7 thus advantageously take the form of a first set of inner seals 7 curved about a first circle and concentric with the rotational axis of the drive shaft 11, and a second set of outer seals 7 curved about a second circle larger in diameter than the first circle and concentric with the rotational axis of the drive shaft. The inner seals 7 extend between adjacent edges of the annular seals 6, along an inner circle corresponding to the edges of the seals 6 closer to the drive shaft 11. The outer seals 7 extend between adjacent edges of the annular seals 6, along an outer circle corresponding to the edges of the seals 6 more distant from the drive shaft 11

As best seen in FIGS. 2, 3, 10*c*–*d* and 10*f*, a recess 21 is formed in the exterior surface of the connecting rod 40 and extends a length sufficient to connect with a radial fluid passage 15 which extends from the skirt of piston 4 to the piston roller journal bearing 19. This external surface actually faces inward toward the rotational axis of shaft 11. In the depicted embodiment, the fluid passageway 21 extends along the rotational axis of shaft 11 and along the reciprocating axis of piston 4, while the fluid passageway 15 extends radial to the piston head and radially from the rotational axis. The exterior recess forming fluid passageway 36 is in fluid communication with the fluid passages 38 and 20 in shaft 11. The journal bearing 19 advantageously, but optionally, has a fluid passage 15 that extends between the side of the disk shaped bearing 19, and the circular outer periphery of the bearing which abuts the piston roller 17.

As best seen in FIG. 2, there is thus preferably provided a fluid passageway extending along the rotational axis of drive shaft 11 through passageways 12, 20, and then extending outward (preferably radially) to communicate with passageways 21, 36 in the piston 4 to provide a fluid connection to the piston roller 17 through passageway 15. As best seen in FIGS. 2*a* and 2*b*, there is advantageously provided a continuous path at all times for lubricating and cooling oil flow to journal bearing 19 and piston roller 17, preferably from the central passageway 20. Further, the bearing surface 16 on the piston connecting rod 40 is also aligned with flow passageways 21, 36, 38 (preferably radial) to lubricate and cool that contact area.

Referring to FIGS. 2–5 and 11, bearing surface 16 is the bearing surface on the connecting rod 40 of piston body 4 that carries the radial load generated by centrifugal force as the piston 4 rotates with the cylinder block 2. The piston bearing surface 16 slides around the inner diameter of the guide track 3, and is configured to do so. The piston bearing surface 16 is preferably located in line with the piston assembly's center of gravity.

Referring to FIGS. 2–5, the bearing surface 16 forms the interior facing surface of the connecting rod 40. The bearing surface 16 abuts against and slides along the cylindrical bearing surface 22 forming the inside of the guide track 3, and is advantageously curved to mate with and slide along that cylindrical surface 22. As the cylinder block 2 and pistons 4 rotate about shaft 11, the pistons are forced radially outward by centrifugal force, and the bearing surfaces 16, 22 counteract that radial force.

The piston rollers 17 on each piston 4 roll against the guide track surface 23, which surface is inclined or cammed to transform the reciprocating motion of pistons 4 into rotary motion of the output shaft 11. The surface 23 is thus the surface that the piston rollers 17 bear against and that also controls the axial movement of the pistons. In the doubled headed engine 1, two pistons piston 4 are connected by connecting rod 40 so the roller 17 associated with each piston is guided by an opposite surface of guide track 3. As the piston 4 reciprocates along the longitudinal axis of drive shaft 11, the roller 17 moves toward and away from the cylinder head 5 associated with each particular piston 4. The guide track 3 is shaped to follow and guide this motion of the roller 17 and thus of the piston 4 associated with the roller. For each pair of pistons 4 connected to a common connecting rod 40, the associated rollers 17 ideally roll along the opposing surfaces 23 of the guide track 3. In practice slight misalignments cause one or the other roller 17 to be in contact with the associated surface 23 while the other roller is slightly out of contact or in contact but exerting a different pressure on the associated surface 23.

Figure 4:
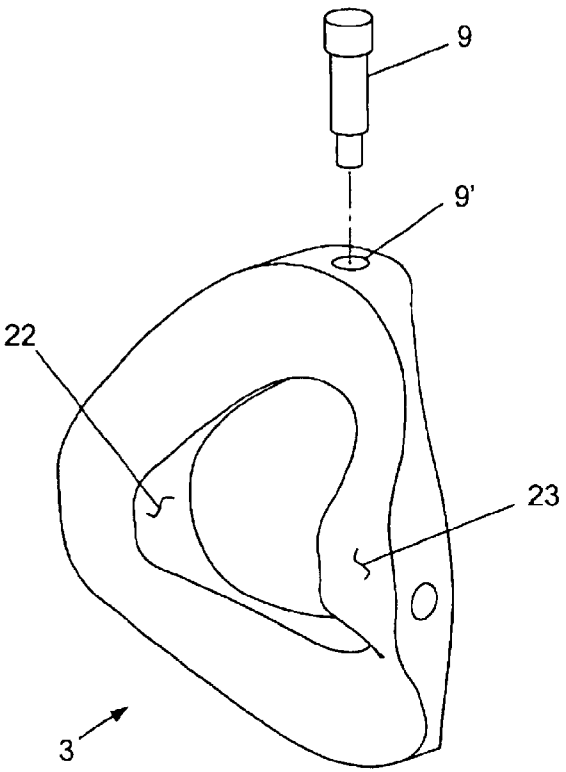
FIG. 4 is a perspective view of a guide track shown in FIG. 1*a;*

Referring to FIGS. 4 and 11, the inner and outer peripheries of the guide track are circular. The opposing surfaces 23 on the guide track 3 are not parallel along the circumference of the guide track even though the rollers 17 are designed to remain in contact with the associated surface 23 of the guide track. There opposing rollers 17 are confined by connecting rod 40 to extend along a straight line and are confined by cylinders 32 to reciprocate along a line parallel to the rotating shaft 11. As this straight line intersects the inclined surfaces 23 the spacing between opposing surfaces 23 will change, and that accounts for the non-uniform spacing between opposing surfaces 23. When the piston 4 is at the top dead center or the bottom dead center there is a slight dwell and the opposing surfaces 23 are generally parallel to each other for a short time. As the pistons 4 move between top and bottom dead center, the pistons accelerate to a maximum about half way between those two positions, and thus the guide track 4 is inclined at its greatest angle and the opposing surfaces 23 are closest together. By changing the inclination of the opposing surfaces 23, the amount of dwell and the power transfer from the piston to the roller 17 to the ring 3 can be varied.

When the opposing surfaces 23 are parallel to each other, they tend to be apart the most, providing a thicker guide track. The guide track 3 is non-rotating, and the thicker portions of the guide track provide a good location at which to fasten the guide track 3 to the motor casing 1 using fasteners 9, such as threaded fasteners. FIGS. 4 and 11 thus shown holes 9' into which the fasteners 9 are inserted to connect the guide track to the motor casing or housing 1.

Figure 10C:
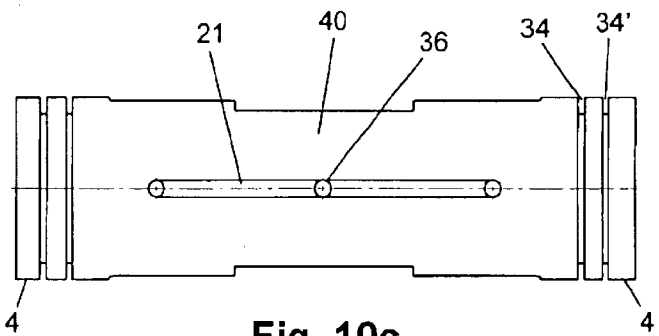
FIG. 10*c* is a plan side view of the piston of FIG. 10*a* taken from the inside of the engine looking outward.
Figure 10B:
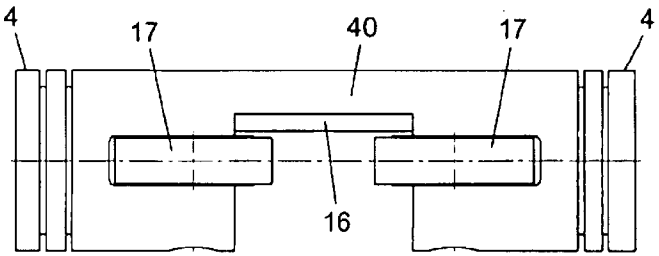
FIG. 10*b* is a plan top view of the piston of FIG. 10*a;*
Figure 10A:
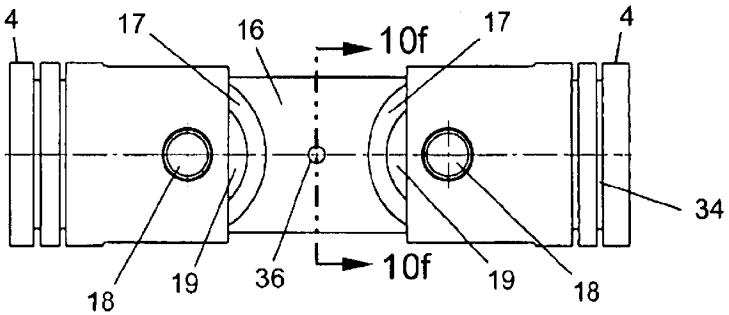
Figure 10D:
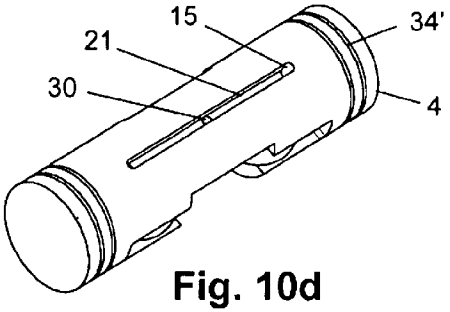
FIG. 10*d* is a perspective view of the piston of FIG. 10*a* looking at the surface of the piston that faces inward as the piston is shown in FIG. 2.
Figure 10E:
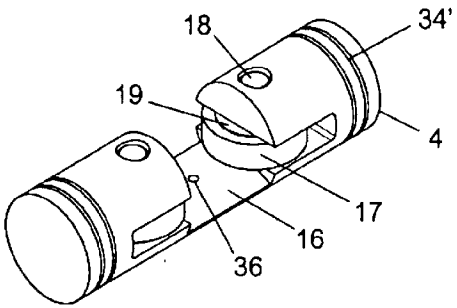
FIG. 10*e* is a perspective view of the piston of FIG. 10*a* looking at the surface of the piston facing outward as the piston is shown in FIG. 2.
Figure 10F:
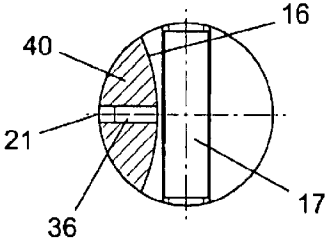
FIG. 10*f* is a sectional view of the piston of FIG. 11*a* taken along section 10*f*—10*f* of FIG. 10*a;*
Figure 11A:
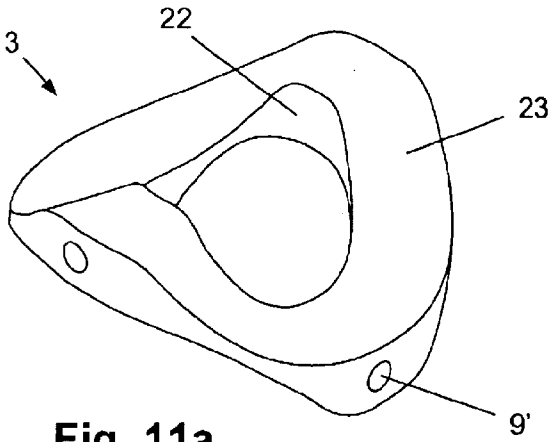
FIG. 11*a* is a perspective view of a guide track used in the motor of FIG. 2.
Figure 11B:
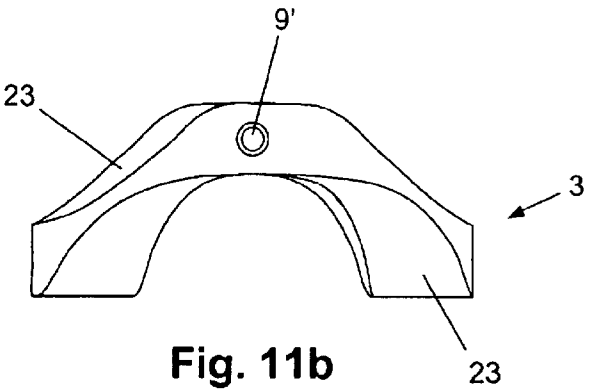
FIG. 11*b* is a side view of the guide track of FIG. 11*a;*
Figure 11C:
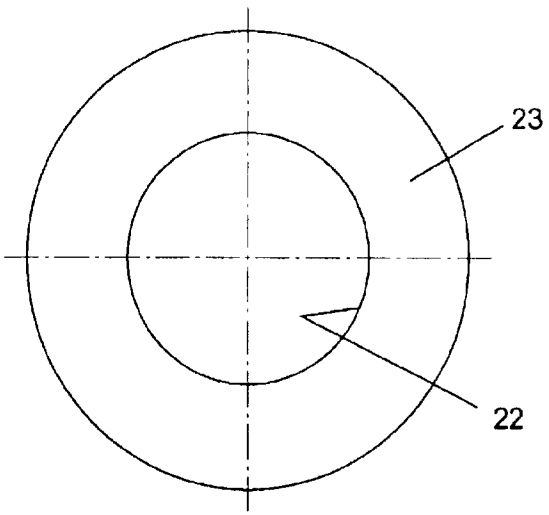
FIG. 11*c* is a top view of the guide track of FIGS. 11*a* and 11*b* taken along a rotational axis of the guide track.
Figure 11D:
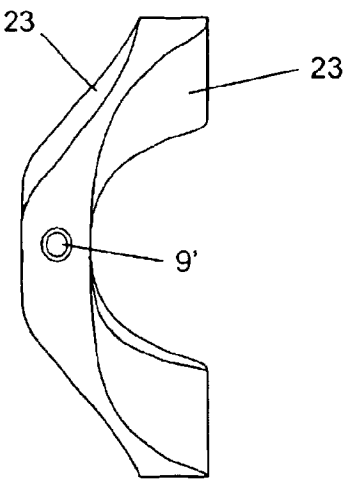
FIG. 11*d* is a side view of the guide track of FIG. 11*a* taken along an axis perpendicular to the view of FIG. 11*b;*
Figure 12A:
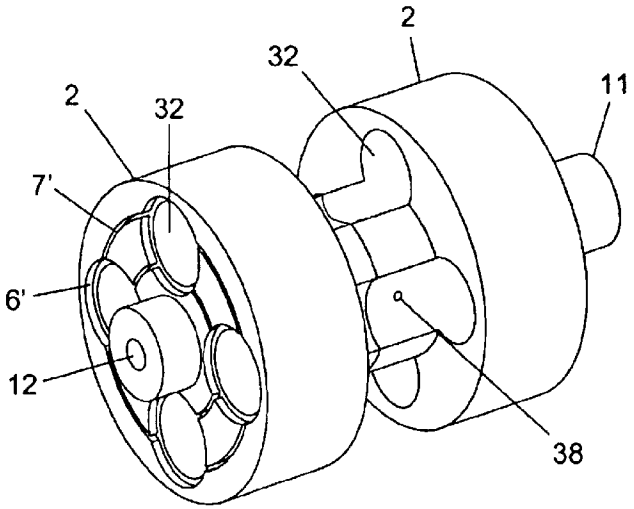
FIG. 12*a* is a perspective view of two rotating cylinder blocks as shown in FIG. 2.
Figure 12B:
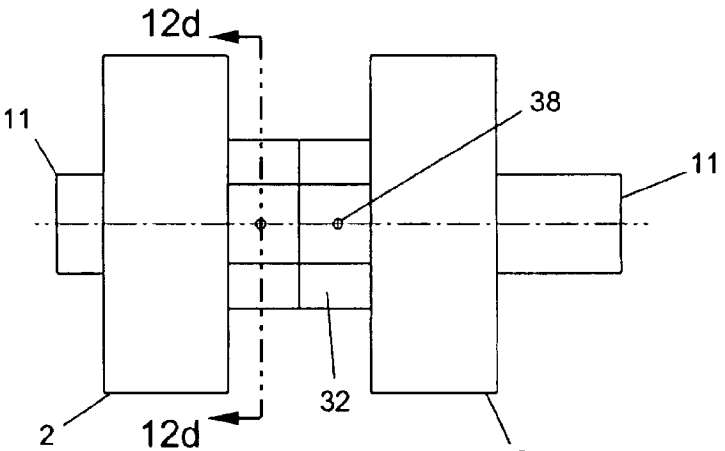
FIG. 12*b* is a plan side view of the rotating cylinder blocks of FIG. 12*a;*
Figure 12D:
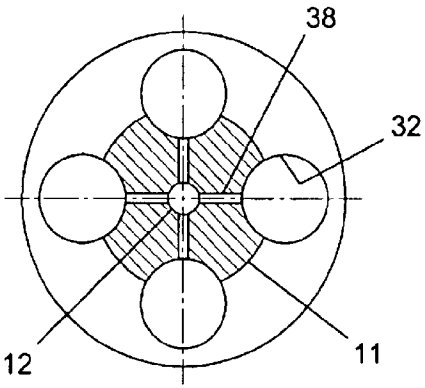
FIG. 12*d* is a section of the cylinder blocks of FIG. 12*b,* taken along section 12*d*—12*d.*
Figure 12C:
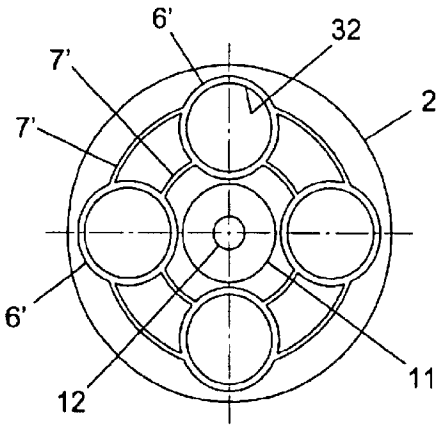
FIG. 12*c* is a left end view of the cylinder blocks of FIG. 12*b;*.

Referring to FIG. 10*f*, it can be seen that the cross section of the connecting rod 40 is such that when constrained between cylinder bore surface 32 and cylindrical inner surface 22, the piston assembly is prevented from rotating within its cylinder bore and piston roller 17 is maintained in the correct rolling direction and orientation relative to guide surface 23. Rotation of the piston 4 within its cylinder 32 could cause the roller 17 to be skewed to the direction of travel around guide surface 23, and that would increase wear on the parts.

Figure 6:
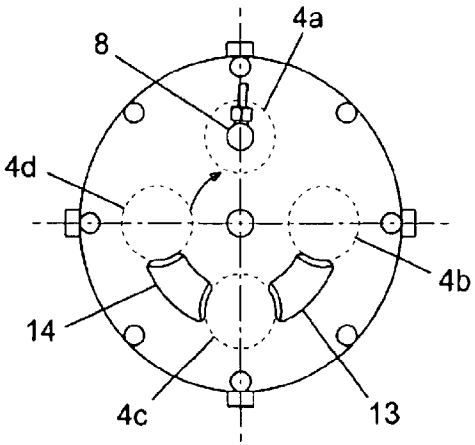
FIG. 6 is a front view of the motor of FIG. 1 with the number one piston in a position of top dead center.

Referring to FIGS. 6–9, the operation of the engine 30 is illustrated using a four stroke combustion cycle that includes intake, compression, power and exhaust strokes or steps. The cycle would be modified accordingly if a two stroke combustion cycle were used. FIG. 6 shows an end view of the motor 30 with the outline of the rotational location of the number 1 piston at top dead center position. The number 1 piston is referred to as piston 4*a*, with the number 2, 3 and 4 pistons being numbers 4*b*, 4*c* and 4*d*, respectively. This location of piston 4*a* is just at the beginning of the power stroke of the motor 30. Piston number 1 corresponds to the piston on the upper left as shown in FIG. 2*a*. Piston 4*b* has just completed the combustion or power stroke, piston 4*c* has just completed the exhaust stroke, and piston 4*d* has just completed the intake stroke.

As the fuel is ignited in the cylinder 32*a* associated with the number 1 piston 4*a*, the piston moves away from the cylinder head 5 and the roller 17 associated with the piston pushes against the guide track 3 as the roller 17 rolls along the surface 23 of the guide track. The inclination between the surface 23 and roller 17 is such that the guide track 3 is inclined clockwise in the image, causing the cylinder block 2 and pistons 4 and drive shaft 11 to also rotate clockwise.

Figure 7:
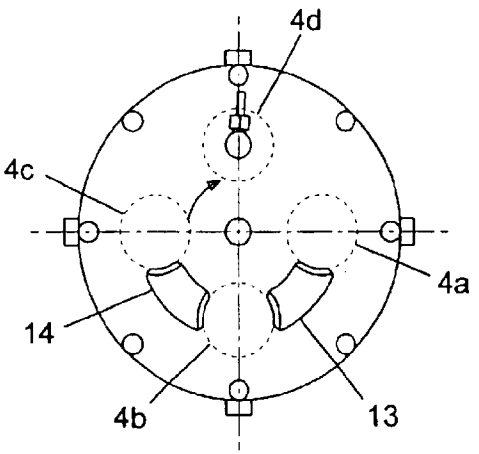
FIG. 7 is a front view of the motor of FIG. 1 with the number one piston in a position of bottom dead center prior to exhaust.

Referring to FIGS. 7 and 2*b*, the number 1 piston 4*a* has rotated clockwise 90 degrees and is near the bottom dead center position at the end of the power stroke. In a non-rotating, reciprocating piston engine the exhaust valves would now open but in this motor 30 the exhaust valve 13 is always open and the piston has to rotate past the valve, which it does. As the piston 4*a* rotates past the exhaust port 13, the piston 4*a* is moving toward the cylinder head 5 and the always-open port 13 so gas is exhausted. The piston on the lower left of FIG. 2*b* shows the number 1 piston 4*a* aligned with the exhaust port 13. Referring to FIG. 7, in this position, the number 2 piston 4*b* has just completed the exhaust stroke, the number 3 piston 4*c* has just completed the intake stroke and the number 4 piston 4*d* is just beginning the power stroke.

Figure 8:
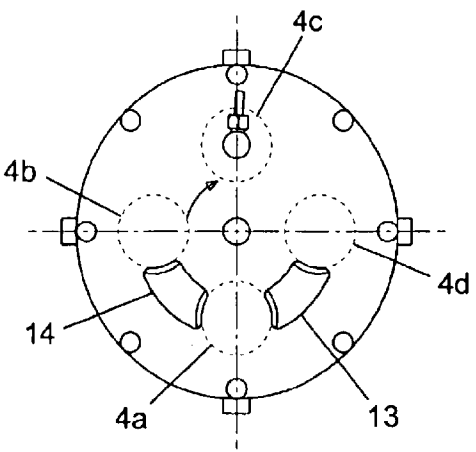
FIG. 8 is a front view of the motor of FIG. 1 with the number one piston in a position of top dead center after exhaust.

FIG. 8 show shows an end view of the engine 30 with the rotational location of the number 1 piston 4*a* near the top dead center position at the end of its exhaust stroke. As the piston 4*a* passed the open exhaust port 14, gases in the cylinder 4*a* associated with the piston 4*a* were exhausted through the port 13. The number 2 piston 4*b* has just completed the intake stroke, the number three piston 4*c* is just beginning the power stroke, and the number 4 piston 4*d* has just completed the power stroke.

Figure 9:
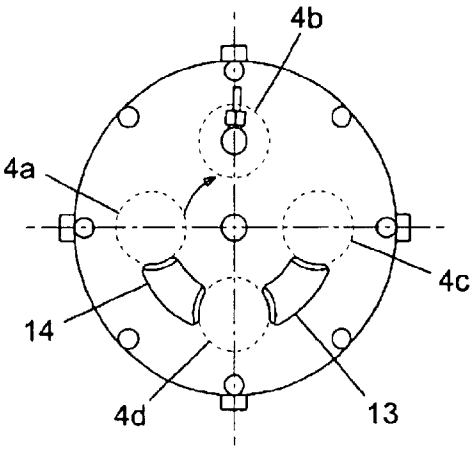
FIG. 9 is a front view of the motor of FIG. 1 with the number one piston in a position of bottom dead center after the intake cycle and FIG. 10*a* is a plan side view of a double headed piston as used in FIG. 2 taken from the outside of the engine looking inward.

FIG. 9 show shows an end view of the engine 30 with the rotational location of the number 1 piston 4*a* near the bottom dead center position at the end of the intake stroke. As the piston 4*a* passed the intake port 14 air or an air and fuel mixture was drawn into the cylinder 32*a* associated with the piston 4*a*. As the piston 4*a* completely passed the intake port 14, the seals 6, 7 (FIG. 3) prevent the escape of gases now contained in the cylinder 32*a*. In this orientation, the number 2 piston 4*b* is just ready to begin the power stroke, the number 3 piston 4*c* has just completed the power stroke and the number 4 piston 4*d* has just completed the exhaust stroke. The combustion cycle is ready to begin again. This combustion cycle would apply if a single headed engine were used.

Referring to FIGS. 1, 2 and 6–9, the pistons 4 are preferably double ended pistons and are shown as such. Thus, when the number 1 piston 4*a* is at the beginning of the power stroke as shown in FIG. 6, the connected piston 4*a*' which is connected to piston 4*a* by connecting rod 40 has just completed the intake stroke. It is one step behind the piston 4*a* in the four stroke cycle. When the number 1 piston 4*a* has completed the combustion or power stroke and is in or near the bottom dead center position as shown in FIG. 7, the connected piston 4*a*' is near the top dead center and has just completed the compression stroke. When the number 1 piston 4*a* is in has completed the power stroke and is in the position shown in FIG. 7, the connected piston 4*a*' has just completed the power stroke. When the number 1 piston 4*a* has just completed the intake stroke as shown in FIG. 8, the connected piston 4*a*' has just completed the exhaust stroke and is ready to begin the intake stroke.

The proposed motor 30 is believed able to reduce manufacturing costs by eliminating many of the components, components which can account for more than half of the components in a typical non-rotating, reciprocating piston engine. Since the engine's cylinder block 2 rotates, all the cylinders 32 can share common intake/exhaust ports, spark plugs, fuel injectors, etc. As depicted, the double ended, four cylinder engine 1 needs only two spark plugs or two fuel injectors rather than eight. The cylinder head 5 has no moving valve components. Further, a single ended, 4 cylinder, spark-ignited engine would require 1 spark plug and 1 fuel injector.

An additional benefit of the engine 1 is that since the axial motion of pistons 4 are controlled by a cam 3 and roller 17 mechanism, virtually any type of piston motion desired can be produced by appropriately shaping the cam surface(s) 23. This can be especially beneficial with regards to combustion efficiency, exhaust emissions and combustion noise.

An additional benefit of the motor 30 is that it uses a journal type bearing and roller 17, 19 to support the axial and radial loads generated by the pistons 4 reciprocating and rotating along the drive track 3. Previous motors used rolling elements but not the journal bearings, in part because the design of prior motors with rotating cylinder blocks did not provide suitable lubrication to allow the use of such journal bearings the present motor 30 has addressed that deficiency of prior designs. The journal bearings are more durable and lower in cost, while providing a high efficiency in transmitting power from reciprocating pistons 4 to the inclined or cammed surfaces of guide track 3.

A further benefit of the motor 30 is the use of the lubricating path by which oil flows from the shaft 11 outward, preferably radially outward, with the parts having communicating fluid passageways to provide oil to the bearing surface 22 between the connecting rod 40 and the guide track 3, and to provide oil to the journal bearing 19.

The use of annular seals 6 at the ends of the cylinders 32, and the use of segmented seals 7 to interconnect those ring seals 6, also provides for a more fluid tight motor 30 that has fewer leaks and lower emissions and less noise.

There is thus advantageously provided an internal combustion, reciprocating piston, motor 30 having a rotating cylinder block 2. The journal bearing 19 supports a roller 17 that is fastened to a piston connecting rod 40 or fastened to the piston 4 so the roller 17 pushes against the inclined surface 23 on a stationary guide track 3 fastened to the motor housing 1 in order to cause the cylinder block 2 and pistons 4 to rotate. A lubricant is fed from passageways 12, 20, on or parallel to the rotational axis of the drive shaft 11 and then extending radially outward, through passageways 38 that align with passageways on the piston or piston skirt 21, 36 and preferably extend through the piston skirt to lubricate the journal bearing 19. Advantageously the passageway extends through the bearing 19 to the roller 17. The rotating piston chambers 32 are sealed against the stationary cylinder head 5 by an annular ring 6 at the end of each chamber, and by curved linear seals 7 extending between adjacent annular rings 6.

Various combinations of the fluid passages 12, 15, 20, 21, 36, 38 provide fluid passage means for providing lubricant to the journal bearing 19 and/or roller 17, and the means preferably but optionally includes the fluid passage 15 in the journal bearing 19 that lubricates the roller 17. The centrifugally fed fluid passages 12, 20, 38, 36 provide means for providing lubricant to the bearing surface 16 on connecting rod 40 which abuts against the circular bearing surface 22 of the guide track 3. The direct lubrication helps prevent unacceptable wear and heating of these abutting surfaces, and the design advantageously uses the centrifugal force to help feed the lubricant through the passageways. The lubricating fluid here, and elsewhere in the motor, not only lubricates, but also helps cool the parts, thus serving two functions. The rotation of the drive shaft 11 causes centrifugal force to urge the lubricant in passage 20 outward and the fluid passageways 21, 38, 36, 15 preferably align to further provide pumping of lubricant to and through the journal bearing 19 and bearing surface 22. There is thus provided means for pumping lubricating fluid to the journal bearing 19 and/or the bearing surface 22. The seals 6, 7 provide means for sealing the rotating cylinder head 2 against the stationary cylinder head 5.

The pistons 4 are typically made of metal, preferably steel or aluminum, but other materials can be used, including various ceramic liners, ceramic composites or other composites. The rotating cylinder block 2 is typically made of metal, such as cast iron or aluminum. The connecting rods 40 are made of the same material as the pistons if they are made integrally with the pistons 4. Advantageously the bearing surface 22 is case hardened steel. The guide track 3 is preferably made of metal, such as case hardened steel. The drive shaft 11 is typically a metal such as steel. Other metals or materials can be used for the various components of the engine 1 if they are found suitable for the operational environment of the motor.

The above embodiment describes a motor 30 which rotates the drive shaft 11. If the power is supplied to rotate the drive shaft 11, then the pistons 4 can be used to pump fluid out of the exhaust port 13 and the motor 30 can be used as a pump.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Further, the above description is given by way of example, and not limitation. Given the above disclosure, one skilled in the art could devise variations that are within the scope and spirit of the invention, including various ways of forming the fluid passageways to supply lubricant to the journal bearing 19. Further, the various features of the motor 30 can be used alone, or in varying combinations with each other and are not intended to be limited to the specific combination described herein. Thus, the invention is not to be limited by the illustrated embodiments but is to be defined by the following claims when read in the broadest reasonable manner by one skilled in the art to preserve the validity of the claims.

What is claimed is:

1. A method of lubricating an internal combustion motor having reciprocating pistons in a rotating cylinder block, the pistons being connected to a roller that pushes against an inclined surface on a stationary guide track fastened to a motor housing in order to cause the cylinder block and pistons to rotate about a rotational axis, the drive track having a cylindrical bearing surface that encircles a drive shaft that rotates about the rotational axis, the piston having a curved bearing surface abutting the cylindrical bearing surface comprising:

forming a lubricant passage along the rotational axis and forming outwardly extending fluid passages in the drive shaft which place the lubricant along the rotational axis in fluid communication with at least one location on the exterior of the drive shaft but inside the motor;

placing the at least one location in fluid communication with a piston fluid passageway extending through the piston to an inner surface where the piston bearing surface abuts the cylindrical bearing surface.

2. The method of claim 1, wherein the roller is mounted on a journal bearing, and further comprising providing a fluid passage through the piston to place the journal bearing in fluid communication with the at least one opening.

3. An internal combustion motor rotating a motor drive shaft having a rotational axis, comprising:

a rotating cylinder block within which a plurality of pistons reciprocate along an axis parallel to the rotational axis of the drive shaft, the rotating cylinder block being mechanically coupled to and rotating with the drive shaft;

a non-rotating motor casing having opposing cylinder heads and enclosing the rotating cylinder block, the pistons reciprocating in chambers defined within the cylinder block and further defined by one of the non-rotating cylinder heads;

a non-rotating drive track fastened to the housing and having an inclined surface thereon;

a roller coupled to the piston by a connecting rod, the roller contacting the inclined surface on the drive track, the roller moving around the drive track as the drive shaft rotates; and a journal bearing within the roller.

4. The motor of claim 3, wherein the journal bearing comprises a disk supported by a shaft fastened to opposing sides of the piston, with the roller having an inner surface abutting an outer surface of the disk and a layer of lubricant interposed between roller and the disk so the roller forms part of the journal bearing.

5. The motor of claim 3, further comprising centrifugal means for lubricating the journal bearing.

6. The motor of claim 3, further comprising a fluid passageway in the drive shaft in fluid communication with an outward passageway through the drive shaft that opens onto an outer surface of the drive shaft; and a fluid passageway in the piston having a first end in fluid communication with the outward passageway though the drive shaft, and having a second end in fluid communication with the journal bearing.

7. The motor of claim 6, wherein the roller rolls about a roller axis and the journal bearing comprises a disk fixed on the roller axis with a face perpendicular to that roller axis, the face having an opening to a passageway in the disk that is in fluid communication with the roller and in fluid communication with the fluid passageway in the piston.

8. The motor of claim 6, wherein an annular seal is interposed in a recess in the rotating cylinder block between the end of each cylinder and the adjacent cylinder head to seal the cylinder and forming a plurality of adjacent annular seals, and further comprising:

a plurality of curved linear seals extending between the adjacent annular seals.

9. The motor of claim 3, wherein an annular seal is interposed in a recess in the rotating cylinder block between the end of each cylinder and the adjacent cylinder head to seal the cylinder and form a plurality of adjacent annular seals, and further comprising:

a plurality of curved linear seals extending between adjacent annular seals.

10. The motor of claim 9, wherein the curved seals are curved about a circle that is concentric with the rotational axis of the drive shaft.

11. The motor of claim 9, wherein the curved seals comprise a first set of seals curved about a first circle that is concentric with the rotational axis of the drive shaft, and a second set of seals curved about a second circle larger in diameter than the first circle and concentric with the rotational axis of the drive shaft.

12. The motor of claim 3, wherein the piston is double headed with a connecting rod connecting the two piston heads, the connecting rod having a curved surface thereon located to abut a circular surface on the guide track that encircles the rotational axis, the circular surface being located in a plane that is coaxial with the rotational axis.

13. The motor of claim 12, further comprising a fluid passageway extending through the connecting rod to conduct lubricant to the curved surface of the connecting rod.

14. The motor of claim 12, further comprising a fluid passageway in the drive shaft in fluid communication with an outward passageway through the drive shaft that opens onto an outer surface of the drive shaft within the motor casing, the fluid passageway through the connecting rod being in fluid communication with the fluid passageway through the connecting rod.

15. The motor of claim 14, further comprising a fluid passageway in a skirt of the piston having a first end in fluid communication with the outward passageway though the drive shaft, and having a second end in fluid communication with the journal bearing.

16. The motor of claim 3, wherein the journal bearing is the only bearing within the roller.

17. An internal combustion motor having at least two double headed pistons reciprocating in cylinders located in a cylinder block that rotates about a rotational axis of a drive shaft to which the cylinder block is connected, the double headed pistons being connected by a connecting rod having a curved surface facing inward toward the rotational axis and abutting a cylindrical bearing surface of a stationary guide track fastened to a non-rotating housing within which the cylinder block rotates, the cylindrical bearing surface being in a plane that is coaxial with the rotational axis, the housing having opposing ends each enclosed by a cylinder head with opposing ends of the drive shaft being rotatably supported by the opposing cylinder heads, the piston heads supporting a axle which mounts a journal bearing inside a roller which pushes against a surface of the guide track to rotate the cylinder block and pistons about the rotational axis, the drive shaft having a fluid lubricating passage along its rotational axis, the fluid passage extending outward to at least one location at an exterior surface of the drive shaft, the piston having a fluid passage through the piston in fluid communication with the at least one location and one of the journal bearing and the curved surface of the connecting rod.

18. The motor of claim 17, further comprising an annular seal between a distal end of each cylinder and the abutting portion of the cylinder head, and a plurality of curved seals extending between adjacent edges of the annular seals, the curved seals being generally concentric with the rotational axis.

19. The motor of claim 17, wherein the roller is centered on an axis passing through the center of gravity of the double headed piston and connecting rod to which the roller is fastened.

20. The motor of claim 19, wherein the fluid passage in the piston places both the journal bearing and curved surface in fluid communication with the at least one location on a continuous basis.

* * * * *